US005275245A

United States Patent [19]

Clements

[11] Patent Number: 5,275,245

[45] Date of Patent: Jan. 4, 1994

[54] DEVICE TO FACILITATE CREATING FOXHOLES WITH EXPLOSIVES AND METHOD OF MAKING THE SAME

[76] Inventor: James M. Clements, R.R. 1, Box 186, Newton, Iowa 50208

[21] Appl. No.: 974,789

[22] Filed: Nov. 12, 1992

[51] Int. Cl.[5] ..... E21B 25/14

[52] U.S. Cl. ..... 175/20; 73/864.74

[58] Field of Search ..... 175/19-20; 175/58; 175/161; 175/249, 254; 73/864.74, 864.73

[56] References Cited

U.S. PATENT DOCUMENTS

| | | | |
|---|---|---|---|
| 4,804,050 | 2/1989 | Kerfoot | 175/20 |
| 4,848,484 | 7/1989 | Clements | 175/20 |
| 5,209,129 | 5/1993 | Jaselskis et al. | 175/20 X |

*Primary Examiner*—Thuy M. Bui

*Attorney, Agent, or Firm*—Zarley, McKee, Thomte, Voorhees & Sease

[57] ABSTRACT

A device for facilitating creation of foxholes, and method for making the same, include a tool with a bucket auger having a hollow elongated body with openings along its length. Cutting blades are formed or attached at a distal end of the body and a connection means is formed or attached at proximal end of the body. A quick release connection for attachment of a handle used or extensions used for rotating the auger in the ground is provided. The method of making the auger includes the forming of the body out of a minimum number of pieces of material and forming the blades and the body with smooth and generally seamless connections. The method facilitates economical and mass production of the augers in a light weight but strong and durable form.

20 Claims, 3 Drawing Sheets

DEVICE TO FACILITATE CREATING FOXHOLES WITH EXPLOSIVES AND METHOD OF MAKING THE SAME

BACKGROUND OF THE INVENTION

A. Field of the Invention

The present invention relates generally to creating fox holes in the ground, and in particular, to a device for digging a small diameter hole several feet into soil or ground into which can be placed an explosive charge that when detonated, creates a foxhole. The device is versatile and durable for most uses, but is light weight, quickly and easily assembled, portable and manually operated for making the relatively small diameter bores into the ground. The invention also relates to methods of making such a device.

B. Problems in the Art

Foxholes, for military purposes, offer soldiers some protection from enemy fire. Historically and conventionally, the foxholes are created by soldiers using shovels to manually dig in the ground. To create a hole big enough for one or more soldiers is laborious and time consuming. The need for a quicker and easier way to produce foxholes has long existed.

The use of explosives was developed as an alternative. Explosives can quickly and without any human labor, create a substantial hole in the ground. The primary problem is that for best results, the explosive charge needs to initially be several feet beneath the surface of the ground. The state of the art to accomplish the placement of the explosives was to use mechanically powered machines to drill or bore a relatively small diameter wide hole several feet deep in the ground. The explosive is then placed in the bottom of the bore and detonated to create the foxhole.

The primary problem with such a system is that it requires utilization of the machine. Some of the machines are carried on and/or attached to automotive vehicles. Other machines may be separable from vehicle but are not portable in the sense that they can easily be carried by the foot soldier for substantial distances, and are not compact and light weight. Therefore, while the use of explosives represented an improvement over manually digging the foxhole, it still had certain disadvantages.

The concept was then developed of a portable manually operated soil digging device to create the bore for the explosive. Although this general concept exists, there is presently not known any satisfactory tool which can satisfy the need for a lightweight, high strength, compact and portable tool with quick assembly and disassembly, which is effective for many soil conditions. There is also not known any device which can be economically and efficiently manufactured.

Bucket augers used in soil sampling applications can bore small-diameter holes in the ground. They are generally fairly heavy for strength reasons and made from multiple parts which does not lend them to efficient and economical mass production. Their prime function is to grab and retain a sample of soil for examination.

Hand-operated bucket augers are known in the art and have been used for a number of years for obtaining soil samples from below ground surface. The basic form of a bucket auger is an elongated cylindrical member having a hollow interior. The distal or outer end includes cutting blades or teeth for not only cutting into the soil, but also breaking it up. As the bucket auger is worked downwardly in the soil, the hollow body receives the soil which has been cut and loosened. The cutting blades and the re-compaction of the soil in the bucket auger body allows the tool to be withdrawn with the soil intact. Normally either openings exist along the sides of the body or removable covers exist to allow soil inside the hollow body to be removed. The bucket auger is then reinserted into the bore and digging continues to a desired depth. For relatively deep bores, handle extensions can be utilized. The basic operation of the bucket auger is to utilize a handle to advance the body manually by exerting downward and rotary force to produce a cutting and screwing action into the soil to create the bore. The cutting blades, are configured to work on the principle of a rotating inclined plane.

Generally the use of bucket augers is to bore a hole to a certain depth to then extract a soil sample for analyzation. To accomplish this, either the bucket auger is used, which retains the soil in generally the same vertical sequence as it existed in the soil or since the bucket auger disturbs the soil, other times more specialized soil sampling tools are utilized to obtain the soil sample.

Bucket augers are used in many environments and soil conditions. Therefore, they tend to need to be made of very strong and durable materials. For example, such materials need to resist breakage if used in very hard soil or rocky soil. Moreover, because substantial stress and force are exerted on the bucket auger, and every connection to the handle which is used to rotate the auger in the soil, all those parts also need to be made of strong durable materials. Conventionally, bucket augers tend to be made of a number of different pieces which are connected to one another. There also tends to be substantial discontinuities in the surfaces, such as weld lines, square edges, etc., which impede smooth movement of the auger through the soil or soil into the auger. Bucket augers are not effective, however, in dry or fluid sands or in soil that includes stones that are substantial in size compared to the diameter of the bucket auger.

Therefore, most bucket augers are relatively heavy because of these needs. Also, the joints and connections between the bucket auger and any extensions and handle are generally made to be very strong, further adding to the weight. This also usually adds to the complexity and time needed to assemble and disassemble the tool.

Furthermore, because such specialized ground working tools have these needs, they are generally fairly laborious to make and involve a significant amount of expense and time to manufacture from the standpoint of materials used, labor to shape, form and assemble parts, and other manufacturing steps.

Still further, the nature of these conventional bucket auger tools does not lend themselves to easy and portable transport and quick and easy setup and disassembly.

The problems faced by soldiers is that conditions surrounding the soldier, for example in warfare, are not ideal. If the soldier is under fire, time is particularly of the essence to create the bore in the soil and then to detonate the explosive to create the foxhole. If in nighttime, it is particularly critical to allow easy and quick assembly of the tool, even with minimal vision capabilities.

There is therefore a real need in the art for a device which improves over the problems and deficiencies in the art. It is therefore a principle object of the present invention to provide a device for facilitating the creation of foxholes with explosives and method for making the same which represents an improvement in the art.

Another object of the present invention is to provide a device as above described and method of making the same which is easy to mass produce.

Another object of the present invention is to provide a device as above described and method of making the same which can be made to be light but of substantial strength.

A still further object of the present invention is to a provide a device as above described and method of making the same which is economical to manufacture.

Still further object of the present invention is to provide a device as above described and method of making the same which can be made with efficient use of materials.

Still further object of the present invention is to provide a device as above described and method of making the same which is better adaptable for portable and compact transport and easy and quick set up and disassembly in less than ideal environmental conditions without the need or requirement of additional devices or tools.

Another object of the present invention is to provide a device as above described and method of making the same which allows for easy portable transport and then quick and easy boring of a relatively small diameter hole up to several feet in the ground.

Another object of the present invention is to provide a device as above described and method of making the same which is strong, durable, and economical.

Another object of the present invention is to provide a device as above described and method of making the same which produces a ground working body which has a minimum number of seams or surface discontinuities.

These and other objects, features, and advantages of the present invention will become more apparent with reference to the accompanying specification and claims.

SUMMARY OF THE INVENTION

The present invention relates to a device which is used for boring relatively small diameter holes in the ground to depth of several feet to facilitate placement of an explosive charge to that depth. A primary use of this operation is to explosively create a foxhole for military use. The device generally comprises an improved bucket auger as the end-most section of the tool. It is dissemblable from a handle which is used to manually rotate the bucket auger and advance the bucket auger into the ground, and to lift the bucket auger from the ground. One or more extension members can be assembled between the handle and the bucket auger to lengthen the tool.

The bucket auger according to the present invention is elongated and has cutting blades at a distal end. The body of the bucket auger presents smooth inner and outer surfaces. A plurality of entrance openings to the hollow interior of the body are formed along the longitudinal axis of the body. A connection means exists at the proximal end of the body for connection to either a handle or extension member.

The connection means cooperates with a mating connection means on the handle or extension member to allow for quick and easy attachment and detachment, and compact storage and transport of the entire tool.

The device can be manufactured according to several different alternative methods which allow utilization of relatively light weight yet strong materials in a configuration to produce a strong and durable bucket auger which is capable of efficient and durable use in a variety of soil conditions. Each method also allows for efficient and economical mass production of the devices.

DETAILED DESCRIPTION OF PREFERRED EMBODIMENT

Figure 1:
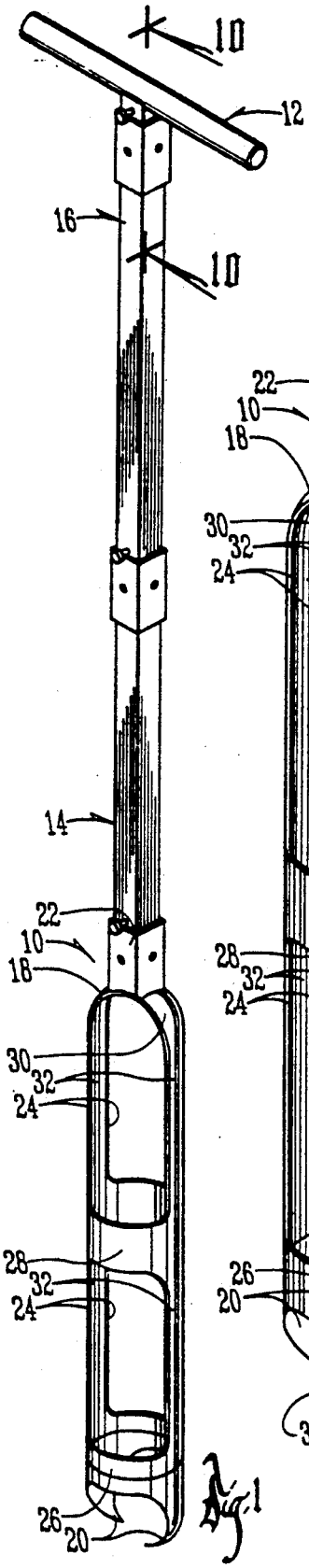
FIG. 1 is a perspective view of a device according to one embodiment of the present invention, as attached to first and second extension members and terminating in a handle to comprise an assembled tool.

To provide a better understanding of the invention, a preferred embodiment of the invention will now be described in detail. The drawings summarized above will be used extensively in this description. Reference numerals and/or characters will be used to indicate certain parts and locations in the drawings. The same reference numerals and/or characters will be used to indicate the same parts and locations in all the drawings, unless otherwise indicated.

FIG. 1 illustrates the general structure of device according to the present invention. A bucket auger 10 is the ground-working part of the tool. FIG. 1 also illustrates a T-shaped handle 12 and two extensions 14 and 16. The complete combination of FIG. 1 illustrates one embodiment of a complete tool that can be used for creating a relatively small diameter bore into most types of soil (exceptions are dry or fluid sand or soil with numerous stones of substantial size compared to the diameter of auger 10).

Bucket auger 10 consists of an elongated cylindrical body 18, cutting blades 20 at what will be called its distal end, and a female connection 22 at its opposite or its proximal end. Openings 24 exist along body 18.

Such as is well known in the art, the tool functions by placing blades 20 of auger 10 to the ground, and attaching handle 12 directly to connection 22. Handle 12 is then manually rotated which in turn rotates blades 20 to cut into the ground and begin a vertical bore in the ground. This process is continued until the length of body 18 is inserted into the ground. The soil then is disrupted and fills up the interior of body 18 and is kept in place by the side walls of the bore. To remove the soil, bucket auger 10 is removed by handle 12 from the bore and the slightly compacted soil inside body 18 is pushed out of opening 24 to clean out body 18.

Handle 12 can then be disassembled from bucket auger 10; and an extension 14 can be connected to connector 22. In turn the handle can be connected to the opposite end of extension 14. Each extension has male and female opposite ends. Bucket auger 10 is then reinserted into the bore, if a deeper bore is needed, and a similar procedure is accomplished to dig essentially another distance substantially equivalent to the length of body 18. In the preferred embodiment, a second extension 16 can be used to dig another similar distance.

Figure 2:
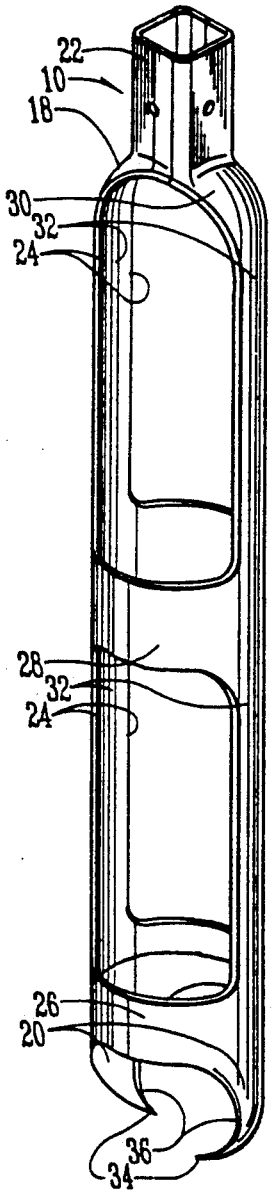
FIG. 2 is an enlarged perspective view of one embodiment of the bucket auger of FIG. 1.

By referring to FIG. 2, an enlarged depiction of bucket auger 10 is shown. Openings 24 expose a substantial amount of the interior of the basically cylindrical body 18. The body 18 is comprised of front, middle, and back ring sections 26, 28, and 30 are connected by longitudinal strap sections 32 and 34. This arrangement makes it easy to evacuate soil from the body 18. Cutting blades 20 are shaped so as to taper to a point end 34 but are also curved along their length. The points 34 therefore actually tend to overlap a little bit and converge from the perimeter of body 18. Leading edges 36 of each blade can be sharpened. Blades 20 therefore function to cut through the soil as auger 10 is rotated. They also function to break up the soil and facilitate its movement into body 18 as auger 10 is moved downwardly in the ground. Finally, blades 20 function somewhat to retain soil in body 18 as auger 10 is removed for emptying. The tips of blades 20 are spaced sufficiently so that rocks or stones of a relatively substantial size compared to the diameter of body 18 can pass into body 18. For example, it is possible to configure blades 20 to allow passage of stones having a diameter at least approximately half that of the interior diameter of body 18.

Connection 22 in the preferred embodiment is simply a squared tubular member with a hollow interior. Four apertures 40 are bored in each side wall. This allows a male mating end 42 (see FIG. 9) of either handle 12 or an extension 14 to be inserted into connection 22. As will be discussed further, a locking pin 44 (see FIG. 9) would engage any one of apertures 40 and lock auger 10 to either handle 12 or extension 14, as the case may be.

The basic configuration of the device according to the invention, including bucket auger 10 and its associated extensions and handle, has now been described. Following is a discussion of alternatives for methods of producing bucket auger 10, and the preferred embodiment for the coupling for connecting the various components.

Figure 3:
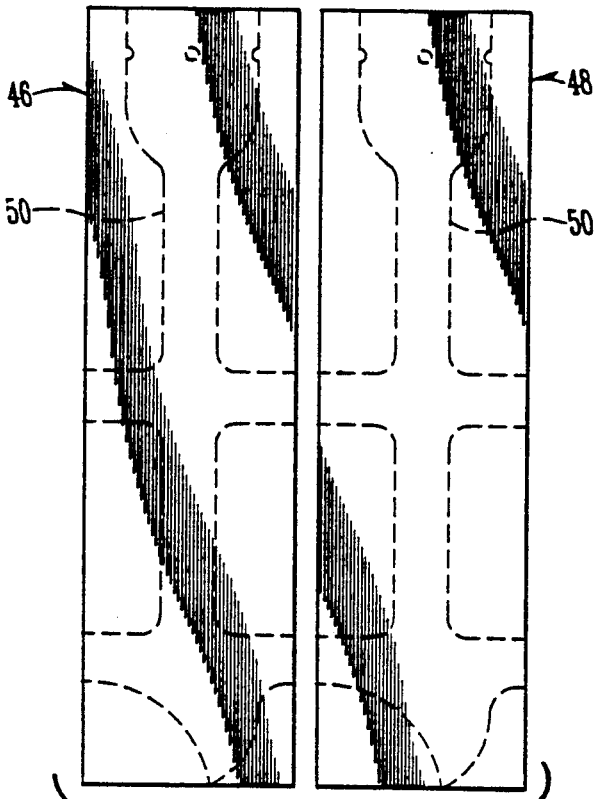
FIG. 3 ,is a top plan view of a manufacturing step for one method of producing the bucket auger of FIG. 2.
Figure 4:
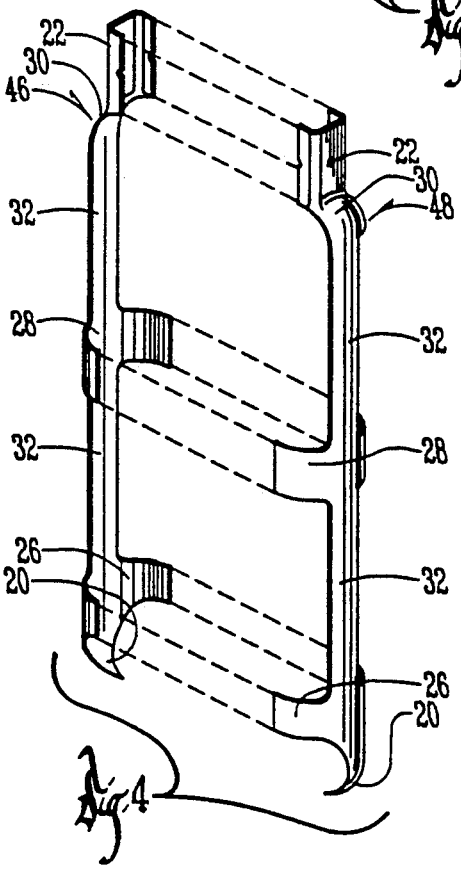
FIG. 4 illustrates a subsequent step from FIG. 3 to form the bucket auger of FIG. 2.

FIG. 3 illustrates two pieces 46 and 48 of flat metal stock (for example, medium carbon steel sheet). In the preferred embodiment, the longitudinal length of bucket auger 10 in FIG. 2 is approximately 15–17 inches. The diameter of body 18 is approximately 3 inches. Therefore, each piece 46 is approximately 15–17 inches in length and around $4\frac{1}{2}$–$4\frac{3}{4}$ inches in width. As can be seen by dashed lines, identical halves for body 18 can be cut from each piece 46 and 48, including openings 24 and apertures 40. It is preferred that such cutting be done by a laser which can automatically, accurately, and with minimum human labor create the basic pieces for auger 10. Once cut from pieces 46 and 48, as shown in FIG. 4, each half can be shaped by a press device, and then the opposite basic mirror-image pieces can then be fitted together and secured to one another. In the preferred embodiment this would be accomplished by seamless welding along the seam between each half. Laser welding is preferred because it actually facilitates the melting of material from each half along the seam, and the merging of the two portions without a raised or otherwise non-smooth seam, as opposed to traditional welding which adds material at the seam or joint which either remains, or must be machined off, to create a smoother surface.

It is to be understood that with regard to FIGS. 3 and 4, blades 20 are integral with each identical half. However, if desired, blades 20 could be made separately (see for example FIG. 6) and formed separately and then attached to body 18 by laser welding or other connection means. This may be advantageous if a certain type of material for blades 20 is desired, which is different than the remainder of auger 10.

Figure 5:
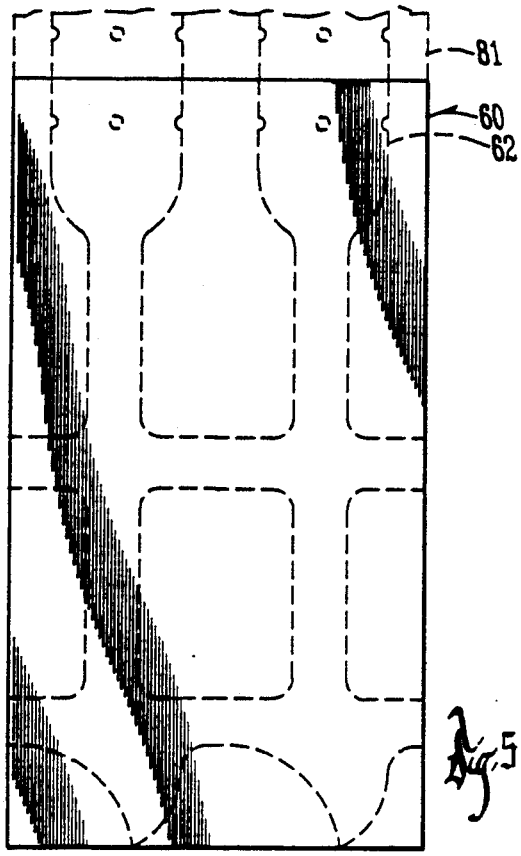
FIG. 5 is the top plan view of an alternative step in the formation of a bucket auger to that of FIG. 3.

FIG. 5 illustrates a further alternative method. A single piece 60 of flat stock metal of approximately double the width of piece 46 or 48 is used. Dashed lines 62 indicate the cut lines to create the shape of auger 10 in its flat projected form. By then shaping the cutout from piece 60 appropriately, the basic shape of auger 10 in FIG. 2 can be achieved by welding the seam between the free edges that come into abutment when forming the cylindrical body of auger 10. It should be understood that, if desired, by doubling the length of any of pieces 46, 48, 60, or 66, an identical, mirror-image part could be made end-to-end so that the cut-out for two (or four) bodies could be made from one piece. (See e.g. dashed lines 81 in FIG. 7 for example).

Figure 6:
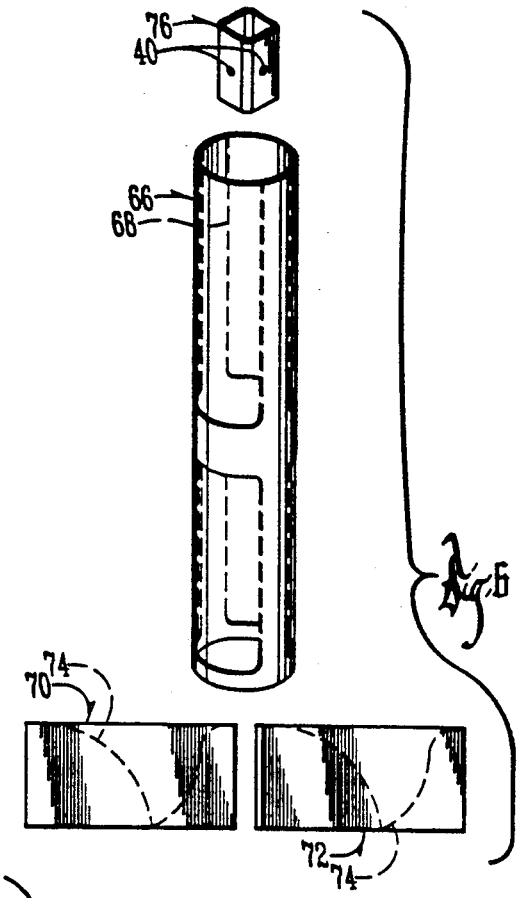
FIG. 6 is a still further alternative to forming a bucket auger according to the present invention.

FIG. 6 shows still further alternative to the forming of auger 10. A cylindrical tubular piece 66 of metal tubular stock is a starting point. Dashed lines 68 show the cut lines for, in the preferred embodiment, laser cutting from piece 66. In this embodiment, flat stock pieces 70 and 72 are used for blades 20.

Figure 7:
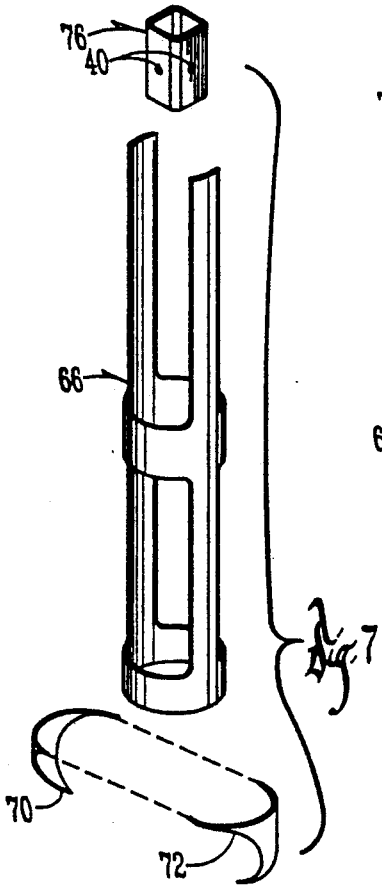
FIG. 7 is a subsequent step to FIG. 6 in forming a bucket auger.

FIG. 7 shows that once cylindrical piece 66 is cut (to basically create openings 24), and connection 22 is made from a squared piece of metal stock (with apertures 40 appropriately formed), blades 22 would be shaped and would be attachable to the front end of piece 66 (in the preferred embodiment by laser welding for a seamless connection).

Figure 8:
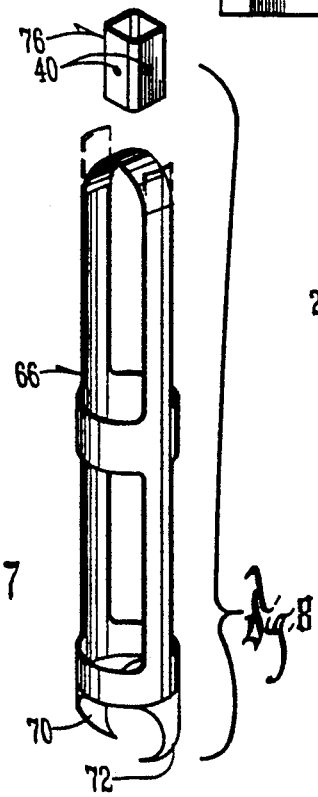
FIG. 8 is a subsequent step to FIG. 7 in forming a bucket auger.

FIG. 8 then shows that the opposite end of piece 66 would be shaped to converge and square piece 76 would then be likewise connected. In this embodiment, the shaping of the end of piece 66 to receive connection 22 would be completed by placing a punch or mandrel inside piece 66 and then bringing a press down on the outside of that piece 66 to converge and curve the end into a form which would receive connection 22. Blades 20 would then be connected to the opposite end of piece 66. The finished auger would be basically a unitary piece of similar thickness metal.

Figure 9:
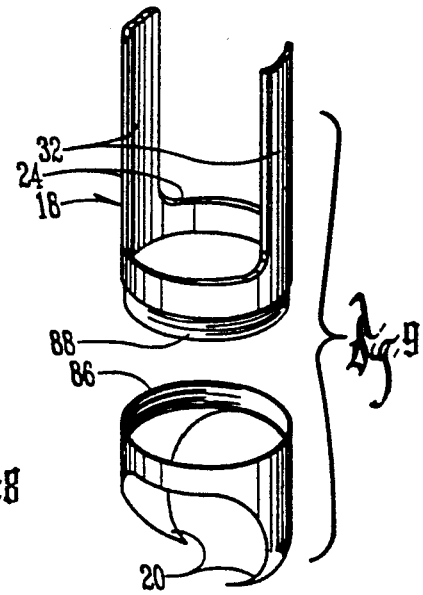
FIG. 9 is a partial perspective view of an alternative method of attachment of cutting blades to a bucket auger body.

FIG. 9 simply shows in partial perspective an alternative method of attachment of blades 20 to body 18. A male threaded portion 86 could be formed with blades 20 and be threadably matable into female threads 88 formed in body 18. This is particularly valuable if the material of blades 20 is so dissimilar to that of body 18 (e.g. ferrous based metal such as steel or iron compared to non-ferrous based metal such as aluminum or magnesium) that welding or other conventional attachment methods are not feasible or desired. It would also allow for interchangeability of blades.

Figure 10:
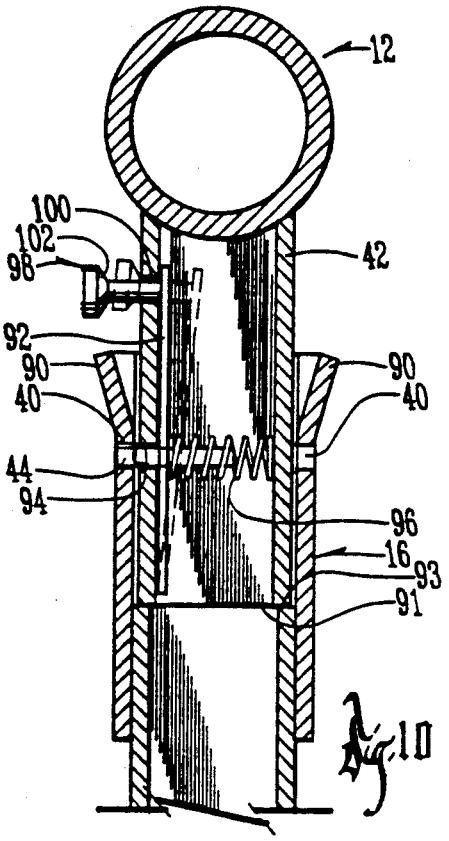
FIG. 10 is an enlarged sectional view taken along line 10—10 of FIG. 1 illustrating a releasable interconnect or coupling between any of: a handle, a bucket auger, extension member, or another extension member.

FIG. 10 illustrates in more detail how auger 10 and either handle 12 or an extension 14 or 16 (or any of the parts 10, 12, 14, and 16) can be interconnected. In FIG. 10, connection 22 for auger 10 (or extension 14 or 16) is shown in cross section. Note that the upper end of connection 22 is flared slightly at reference numeral 90 to serve to automatically receive and then depress locking pin 44 when the male end 42 of handle 12 (or an extension 14 or 16) is inserted into a connection 22. Locking pin 44 would automatically be retracted until it aligns with an aperture 40. Spring 96 would then force locking pin 44 into aligned aperture 40 in connection 22 for a positive and automatic latch. Note also that end surface 91 of male end 42 would concurrently abut end surface 93 of auger 10 (or extension 16) to bear any converging forces between them. Male end 42 includes an interior lever 92 to which button 98 is secured by means well known in the art (preferably threaded connection or press fitting). Lever 92 is disposed basically longitudinally in the interior of male end 42. An aperture 94 exists basically centered along one side of male end 42. It is positioned so that it will coincide with any one of apertures 40 in connection 22 when the parts are pushed together. When the shoulders or end edges 91 and 93 come into abutment, locking pin 44 is automatically located with an aperture 40.

Locking pin 44 is attached to lever 92 by preferably press-fitting into aperture 94. Pin 44 extends substantially across the interior of member 42. Spring 96 surrounds the interior end of locking pin 44 and extends across the interior of male end 42 into abutment with the opposite wall. The function of spring 96 is to urge lever 92 oppositely so that locking pin 44 is urged outwardly of aperture 94. The lower end (in FIG. 10) of lever 92 does not need to be attached to member 42.

Release button 98 is attached to the upper end of lever 92 in the interior of male end 42 and extends out another aperture 100 on the same side of male end 42 as aperture 94. Release button 98 has an enlarged head 102 to create a larger surface for the user to find and press and prevent it from passing through aperture 100 into the interior of male end 42.

The arrangement described above therefore allows easy insertion of male end 42 of handle 12 into connection 22 of auger 10. Locking pin 44 is automatically forced inward to retract locking pin 44 basically flush with the exterior of male end 42. The square (could also be 3, 5, or 6 sided) nature of male end 42 mates with the corresponding nature of the interior of connection 22. It does not matter which orientation between the two sections (male end 42, and connection 22) exists because aperture 40 on each side of female connector 22 all work to lock the sections together. Therefore there does not need to be any directional orientation other than simply square-profile-to-square-profile of male end 42 and connection 22. Spring 96 would urge locking pin 44 outwardly, which would enter an aperture 40 of connection 22 when the parts are sufficiently pushed together and thus locks those parts in place. Release of the connection is easily accomplished by pushing release button 98 and pulling the two parts apart.

The interconnection of extensions 14 and 16 with auger 10 and handle 12, and with one another, is accomplished by a similar type of coupling. No additional piece or tool is needed to connect or disconnect sections of the tool.

Figure 11:
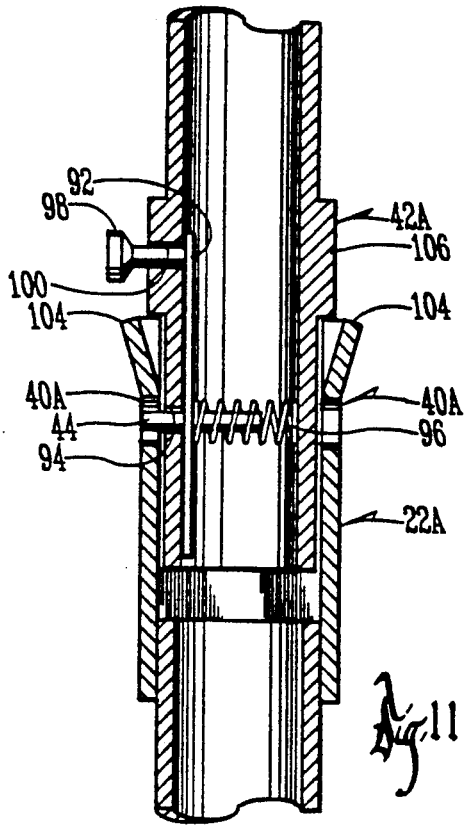
FIG. 11 illustrates in cross-section an alternative coupling system for the invention.

FIG. 11 shows an alternative option for connection between a male end 42 and a female connection 22 according to the present invention. In FIG. 11, what will be designated as female connection 22A, includes radially extended ramps 104 at the outer edge and in the center of each side wall. These ramps 104 function like flare 90 in FIG. 10, to automatically depress locking pin 44 until it is aligned with an aperture 40A. Apertures 40A in each side wall are elongated along the longitudinal axis of female connection 22A.

Figure 12:
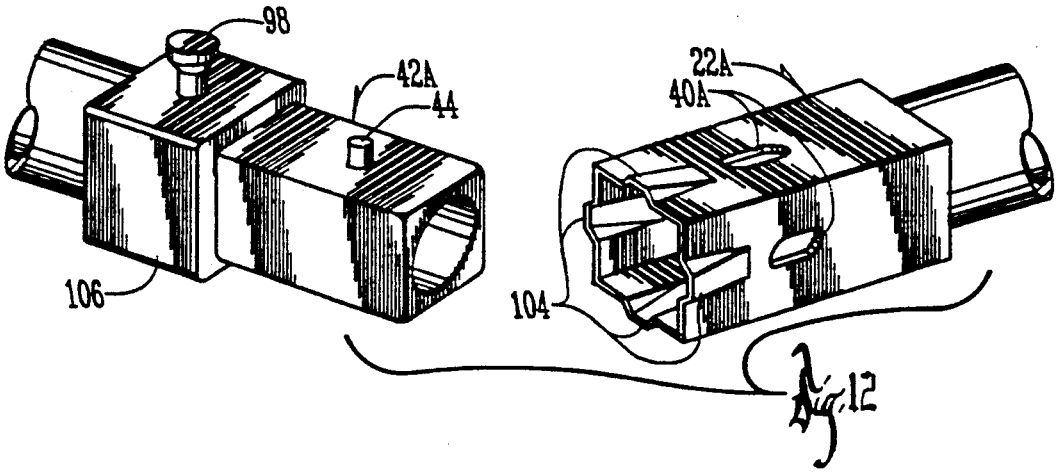
FIG. 12 shows in perspective the coupling system of FIG. 11.

Male end 42A includes a larger diameter portion or sleeve 106 secured by welding or other means to the exterior of male end 42A (or integral with male end 42A). As can be seen in FIG. 12, the basic operation of lever 92, spring 96, locking pin 44, and release button 98, are similar to that described with respect to FIG. 10.

Sleeve 106 abuts extended the upper end of female connection 22A when male end 42A is connected and locked into place with locking pin 44 to female connection 22A, so that if any longitudinal stresses, such as pounding, are experienced or required between the sections, that stress will be born by the abutment of sleeve 106 to the end surfaces of connection 22A. This may occur for example, if the top of the handle 12 or an extension 14 or 16 must be pounded to assist in driving bucket auger 10 or other types of soil boring or sampling devices into the ground. This serves also to automatically position locking pin 44 longitudinally with one of apertures 40A.

The elongated shapes of apertures 40A would allow the locking pin 44 to be protected from any pounding and would allow for rebound of the pin 44 in that elongated slot 40A when pounding occurs.

With respect of FIGS. 11 and 12, it can also be seen that this type of connection could be used with tubular components for the extensions 14 and 16 or portions of auger 10 or handle 12, if desired, even though the female connection and male end are multi-sided. The female connection can be secured to its extension by welding or other means.

The operation of bucket auger 10 and associated components comprising the tool for bucket auger 10 have been generally described above. A specific example of the advantages of the present invention will be described as follows.

One particular application for the invention according to the preferred embodiment is used to bore holes for setting explosive charges to create fox holes for military applications. The tool according to the present invention can be easily carried because it can be disassembled into small pieces. The manufacturing methods by which the tool can be made saves significant weight which is a desired advantage for such portable use. The interconnection, which eliminates the need for exactly aligning a locking pin with a single aperture in the female connector, facilitates very quick interconnection, while at the same time allows quick disconnection. Such quick and easy assembly could be essential when using the device in this application.

The bucket auger is durable and efficient at boring a hole to a depth of several feet in most soils. The seamless construction of the auger helps and facilitates the movement of soil into the body of the auger and the evacuation of soil from the body. It also helps in maintaining and cleaning the auger.

The construction of the bucket auger according to the preferred embodiment of the invention allows it to be manufactured economically and in a mass production manner with an efficient utilization of materials.

The auger would produce an approximately 3.25" diameter hole up to 42 inches deep. An explosive charge can be introduced to the bottom of the bore which can after detonation explosively produce a fox hole sufficient depth and volume to contain at least one soldier.

In the preferred embodiment the entire tool, bucket auger 10, handle 12, extensions 14 and 16, can be made to be five pounds or less which can be back packed by a soldier or personnel. Formation of the auger, by the method steps described, produces a high strength equal to or surpassing the state of art in both the resistance to torque and metal fatigue. The interior and exterior surfaces would be smooth allowing for unobstructed flow of soil and easy cleaning.

When disassembled it is compact (approximately 17 inches maximum length) but able to produce a hole 42 inches deep. The quick connect couplings allow all elements to be assembled or dissembled in complete darkness in five seconds or less. There is no separate tool or device needed to operate the couplings and the mating parts of the coupling engage in any of multiple orientations.

It will be appreciated that the present invention can take many forms and embodiments. The true essence and spirit of this invention are defined in the appended claims, and it is not intended that the embodiment of the invention presented herein should limit the scope thereof.

For example, bucket auger according to the present invention is preferably made from a medium carbon steel sheet stock (e.g. 4130 alloy steel). Other types of steel and other metals could be used. The lengths and diameters of this preferred embodiment can also be varied according to specified needs and uses.

By way of further example, FIG. 1, extensions 14 and 16 are shown to be made of square metal tubing. FIG. 12 shows that round tubing could be utilized. Round tubing is preferred because it can be used to minimize weight. The ends of the round tubes could actually be shaped into multi-sided male and female connection members instead of attaching separate pieces. Variations in the shapes and configurations of the basic components are possible.

Still further, such things as heat treatment of the abutting surfaces or male and female connections for the couplers according to the present invention can be utilized to assist in rating the highest durability for the tool.

Methods of making the bucket auger have been previously described. It is to be understood that variations in these methods can be carried out while staying within the boundaries of the invention. The concept of cutting the basic shape of the entire auger 10, or a majority of it, out of flat steel sheet and then pressing the flat piece or pieces into a shaped configuration, and then finally joining the seams to complete the unitary auger 10, allow the device to be efficiently and economically mass produced. It also allows the manufacturing of the device to be particularly adaptable to continuous sequential manufacturing steps. For example, the cutting process from flat sheet could then be immediately followed by shaping processes, immediately followed by seamless welding processes. At the completion of one step with one piece, the piece could be moved to the next manufacturing step while at the same time a succeeding piece could move into the previous manufacturing step.

As previously discussed, another primary advantage of the method of manufacturing the auger in this fashion is the ability to form an essentially unitary or monolithic auger. This allows the entire auger to be formed out of minimum number of pieces (even one piece) of medium carbon steel or other similar material. Overall strength and resistance to metal fatigue is increased by reducing stress concentrations caused by abrupt changes in cross sectional areas, which is experienced with most conventional ways of manufacturing bucket auger tools. Therefore, even though the auger can be formed efficiently and economically out of the same thickness and type of material, it allows the auger to be light weight yet have high strength equal to or surpassing the state of the art augers in both resistance to torque and metal fatigue.

This unitary or virtually one piece construction allows for interior and exterior surfaces to be smooth providing for minimal obstruction to flow of soil and easy cleaning. The smoothness also improves the working characteristics of the tool when boring a hole in the ground by allowing the soil to flow over surfaces without significant obstruction.

If the auger is not cut completely from one piece of material, opposite identical halves could be cut from single pieces of flat stock. Even when a cylindrical body is used, the blades can be made from flat stock if needed. The blades and a circular ring could be produced and connected, and then that combination in turn can be connected to the end of the cylindrical body for the auger. Therefore, for example, like shown in FIG. 9, the blades and the ring for the cutting head of the auger could be initially cut from flat stock, seamlessly welded together, and then instead of threaded connection to the body 18, it could be seamlessly welded to the body 18. This again contributes to good strength and durability with smooth surfaces.

It is also to be understood that the quick coupling mechanism as shown in the present application is significant in its ability to allow automatic and positive latching of parts together with easy interconnection even in the dark. Importantly, disassembly is also easy by utilization of the easy to locate release buttons.

It is furthermore to be understood that while the present description is related primarily to use of the tool in digging small bores for explosively creating foxholes, the auger and the entire tool could also be utilized for virtually any analogous situation where a relatively small diameter bore is required to be made in a wide range of soil.

What is claimed is:

1. A portable, light weight, compact manually operated device to facilitate creation of foxholes by explosive action comprising:

a bucket auger means including a generally cylindrical body portion with a hollow interior, a distal end, a proximal end and a plurality of openings along said body;

cutting blades at the distal end of the body; and a coupling means at the proximal end of the body;

the body and blades having walls of substantially similar cross-sectional thickness with generally smooth exterior and interior surfaces.

2. The device of claim 1 wherein the coupling means comprises a female connection means having a generally multisided-in-cross section hollow member, with an aperture generally centered in the middle of each side wall of the connection means.

3. The device of claim 2 wherein each aperture is elongated along a longitudinal axis of the connection means.

4. The device of claim 2 further comprising shoulder means at the outer end of the female connection means.

5. The device of claim 4 further comprising a male connection member mounted to an attachment member, the male connection member having a mating portion slightly smaller than but generally conforming to the interior shape of the female connection member, and having shoulder means slightly larger than the interior of the female connection member so that upon insertion of the male member into the female connection member, the shoulder means would abut the shoulder means of the female connection member.

6. The device of claim 5 further comprising a locking means for locking the female connection member and a male connection member together when the shoulder means abut.

7. The device of claim 6 wherein the locking means comprises a spring loaded locking pin moveable between a retracted position with an outer end basically flush with the outer surface of the male member, and an extended position where the spring biases the locking pin outwardly from the surface of the male member.

8. The device of claim 7 further comprising a ramp means on the female connection member for automatically moving the locking pin to a retracted position when the male connection member is inserted in the female connection member, the spring automatically returning the locking pin to an extended and locking position upon alignment of the locking pin with an aperture in the female connection member.

9. A bucket auger device made according to the following steps:

forming from generally equal-in-cross-sectional-thickness metal sheet a generally cylindrical body having a hollow interior, a distal end, a proximal end, and a plurality of openings in said body, a connection means, and cutting blades;

forming a coupling means at said proximal end;

forming said cutting blades at said distal end.

10. The device of claim 9 wherein the forming is performed by pressing means.

11. The device of claim 9 wherein the step of forming a generally cylindrical body comprises cutting a piece of metal cylindrical stock to length and cutting said openings along the length of the cylindrical stock.

12. The device of claim 9 wherein the step of forming a generally cylindrical body comprises cutting two pieces of flat metal stock to generally rectangular shape; cutting mirror image shapes of the cylindrical body in plan projected view from each piece of flat stock; shaping each cut shape into identical semi-cylindrical shapes; joining the two semi-cylindrical shapes into a generally cylindrical body.

13. The device of claim 12 wherein the semi-cylindrical portions are joined by seamless welding.

14. The device of claim 9 wherein the step of forming a generally cylindrical body comprises cutting a single piece of flat metal stock to shape, cutting a plan projected view of the generally cylindrical body from the flat piece of stock shaping the flat cutout piece into the generally cylindrical body, and joining the free abutting edges of the shaped piece.

15. The device of claim 9 wherein the blades are cut from at least one separate flat metal stock pieces.

16. The device of claim 9 wherein the blades are cast and then attached to the body to form the blades at the distal end of the body.

17. The device of claim 9 wherein the blades are made of a dissimilar metal to the metal of the generally cylindrical body.

18. The device of claim 9 wherein the cutting is accomplished laser means.

19. The device of claim 9 wherein joining of portions of the body after shaping is made by laser welding to present a seamless joint.

20. A bucket auger device made according to the following steps:

cutting a piece of flat metal stock to the length of basically two cylindrical bodies for a bucket auger;

cutting three sets of elongated apertures on opposite sides of the stock, the center aperture being approximately twice as long as the other apertures;

cutting the tubular stock transversely through approximately the middle of the center aperture to create two identical unformed bodies;

shaping each unformed body into a generally cylindrical form;

forming the back end of each body by inserting a punch means inside the body and using a press means to converge and shape the end of each of the bodies into a coupling means;

forming cutter blades at the front end of the cylindrical form of each body; and welding any seams by seamless welding means, so that two identical strong, durable, smooth surfaced bucket auger devices are produced.

* * * * *